US008550596B2

(12) United States Patent
Souma et al.

(10) Patent No.: US 8,550,596 B2
(45) Date of Patent: Oct. 8, 2013

(54) NOZZLE PLATE FOR INKJET HEAD, METHOD FOR MANUFACTURING THE SAME, AND TREATMENT LIQUID FOR INKJET HEAD

(75) Inventors: Seiichi Souma, Tomi (JP); Satoshi Tsubamoto, Tomi (JP); Isao Tabayashi, Tomi (JP)

(73) Assignee: Mimaki Engineering Co., Ltd., Tomi (JP)

( * ) Notice: Subject to any disclaimer, the term of this patent is extended or adjusted under 35 U.S.C. 154(b) by 1531 days.

(21) Appl. No.: 12/129,865

(22) Filed: May 30, 2008

(65) Prior Publication Data

US 2008/0297563 A1 Dec. 4, 2008

(30) Foreign Application Priority Data

May 31, 2007 (JP) ..... 2007-144441

(51) Int. Cl.
*B41J 2/135* (2006.01)

(52) U.S. Cl.
USPC ..... 347/45; 347/47

(58) Field of Classification Search
USPC ..... 347/47, 45
See application file for complete search history.

(56) References Cited

U.S. PATENT DOCUMENTS

2007/0211107 A1* 9/2007 Ikeda ..... 347/47

FOREIGN PATENT DOCUMENTS

| | | |
|---|---|---|
| JP | 2003-63014 | 3/2003 |
| JP | 2005-7789 | 1/2005 |

* cited by examiner

*Primary Examiner* — Kevin S Wood
(74) *Attorney, Agent, or Firm* — Ditthavong Mori & Steiner, P.C.

(57) ABSTRACT

A nozzle plate for an inkjet head including a substrate and ink ejecting holes formed in the substrate. An ink-repellent layer is formed on an ink ejecting side surface of the nozzle plate, and portions of the ink-repellant layer around the ink ejecting holes are selectively removed so that portions of the nozzle plate around the ink ejecting holes are exposed. Also, a method of producing a nozzle plate for an inkjet head is provided that includes preparing a nozzle plate which includes a substrate and ink ejecting holes formed in the substrate and has an ink-repellent layer formed on an ink ejecting side surface of the nozzle plate, and selectively removing portions of the ink-repellant layer around the ink ejecting holes to expose portions of the nozzle plate around the ink ejecting holes.

12 Claims, 3 Drawing Sheets

NOZZLE PLATE FOR INKJET HEAD, METHOD FOR MANUFACTURING THE SAME, AND TREATMENT LIQUID FOR INKJET HEAD

CROSS-REFERENCE TO RELATED APPLICATION

The present application claims priority to Japanese Patent Application No. 2007-144441, filed on May 31, 2007, the entire contents of which are herein incorporated by reference.

BACKGROUND OF THE INVENTION

1. Field of the Invention

The present invention relates to a nozzle plate for an inkjet head, a manufacturing method and a processing method of the same, and a treatment liquid used for manufacturing and processing the same.

2. Discussion of the Background

Conventionally, there is known a method for prolonging the life of the inkjet head by treating a surface of a nozzle plate for an inkjet head so as to form a surface layer. As such a method, especially a method for forming an ink-repellent layer (water-repellent layer) on the surface of the nozzle plate has been described for example, in JP-A-2003-63014. However, the inkjet head having the layer configuration as described in the aforementioned JP-A-2003-63014 has a problem that when the ink-repellent surface layer around the nozzles is damaged, the surface layer can be corroded and stripped, resulting in interference with the linear advancing property of ejected ink.

To solve this problem, a method for forming a cover plate around an ink ejecting hole of the nozzle plate is provided to make the ink-repellent layer around the nozzles hardly damaged, as described in JP-A-2005-7789. However, the method described in JP-A-2005-7789 involves time and money for the manufacturing process, because the cover plate should be positioned precisely relative to the nozzle plate and then adhered to the nozzle plate, and requires a production facility in a factory because the production process requires complex steps so that it is impossible to allow easy process on demand at a customer's site.

SUMMARY OF THE INVENTION

In one aspect of the present invention, a nozzle plate for an inkjet head is provided that includes a substrate and ink ejecting holes formed in the substrate. An ink-repellent layer is formed on an ink ejecting side surface of the nozzle plate, and portions of the ink-repellant layer around the ink ejecting holes are selectively removed so that portions of the nozzle plate around the ink ejecting holes are exposed.

According to another aspect of the invention, a method of producing a nozzle plate for an inkjet head is provided that includes preparing a nozzle plate which includes a substrate and ink ejecting holes formed in the substrate and has an ink-repellent layer formed on an ink ejecting side surface of the nozzle plate, and selectively removing portions of the ink-repellant layer around the ink ejecting holes to expose portions of the nozzle plate around the ink ejecting holes.

According to a further aspect of the invention, a treatment liquid for an inkjet head is provided which is used for processing a layer formed on a surface of a nozzle plate by co-precipitating a fluororesin with a metal. The treatment liquid contains acidic liquid having a function of decreasing a mechanical strength of the layer formed by co-precipitating the fluororesin with the metal.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIGS. 1A through 1C are schematic illustrations for explaining the function of a nozzle plate according to an embodiment of the present invention having an ink-repellent layer, wherein FIG. 1A is a sectional view showing an embodiment of the nozzle plate of the present invention, FIG. 1B is a sectional view showing a conventional nozzle plate, and FIG. 1C is a sectional view showing another conventional nozzle plate;

FIGS. 2A and 2B are schematic illustrations for explaining a situation that ink ejecting holes of the nozzle plate are filled with treatment chemical, wherein FIG. 2A is a sectional view and FIG. 2B is a perspective view; and FIGS. 3A and 3B are schematic illustrations for explaining a situation that portions of the ink ejecting holes of the ink-repellent layer are selectively removed, wherein FIG. 3A is a sectional view and FIG. 3B is a perspective view.

DETAILED DESCRIPTION OF EMBODIMENTS OF THE INVENTION

Figure 1A:
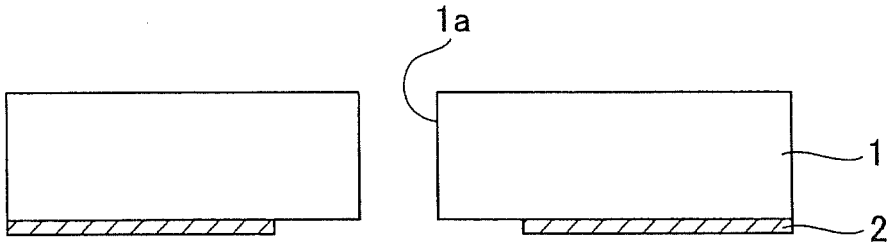

Embodiments of the present invention will be described hereinafter with reference to the accompanying drawings. In the following description, the constituent elements having substantially the same function and arrangement are denoted by the same reference numerals, and repetitive descriptions will be made only when necessary.

The present invention advantageously provides embodiments of a nozzle plate for an inkjet head, a manufacturing method and a processing method of the same, and a treatment liquid used for manufacturing and processing the same which can solve the aforementioned problems in the art. Additionally, embodiments of the invention allow for a process on demand at a customer's site.

The present invention provides embodiments in which, since no ink-repellent layer exists around the ink ejecting hole, the nozzle plate for an inkjet head can solve problems which occur when an ink-repellent layer exists around an ink ejecting hole, as will be described in detail below.

In a manufacturing method and a processing method of a nozzle plate for an inkjet head according to an embodiment of the present invention, portions around the ink ejecting holes (nozzle openings, nozzle orifices) of the ink-repellent layer can be selectively removed in an easy manner as will be described in detail below.

Further, the removal can be easily conducted at a place without a production facility exclusively for processing the nozzle plate, by placing an inkjet head to an inkjet printer before being processed and then supplying the treatment chemical to ink ejecting holes. Therefore, the process on demand at a customer's site is allowed.

Hereinafter, a nozzle plate for an inkjet head according to an embodiment of the present invention will be described with reference to FIGS. 1A through 1C.

According to the nozzle plate for an inkjet head as shown in FIG. 1A, an ink-repellent layer 2 is formed on a surface of an ink ejecting side of the nozzle plate 1 composed of a substrate having an ink ejecting hole 1*a* and a portion around the ink ejecting hole 1*a* of the ink-repellent layer 2 is selectively removed so that the portion around the ink ejecting hole of the nozzle plate (surface) is exposed.

Since no ink-repellent layer 2 exists around the ink ejecting hole 1*a* as mentioned above, this embodiment of the present invention solves the following problems which occur when an ink-repellent layer exists around an ink ejecting hole.

Figure 1B:
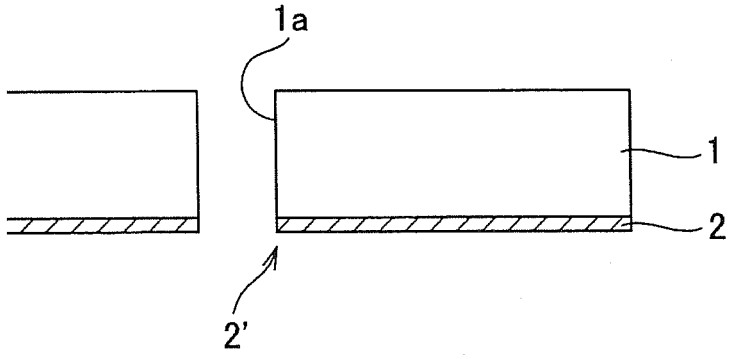

Specifically, in a case in which an ink-repellent layer exists around the ink ejecting hole 1*a* as shown in FIG. 1B (see JP-A-2003-63014), such a structure can be easily physically damaged because an end face (edge) 2' of the ink-repellent layer 2 is wiped by direct touching of a wiper, for example. The damage on the end face (edge) 2' of the ink repellent layer 2 results in interference with the linear advancing property of ejected ink.

Figure 1C:
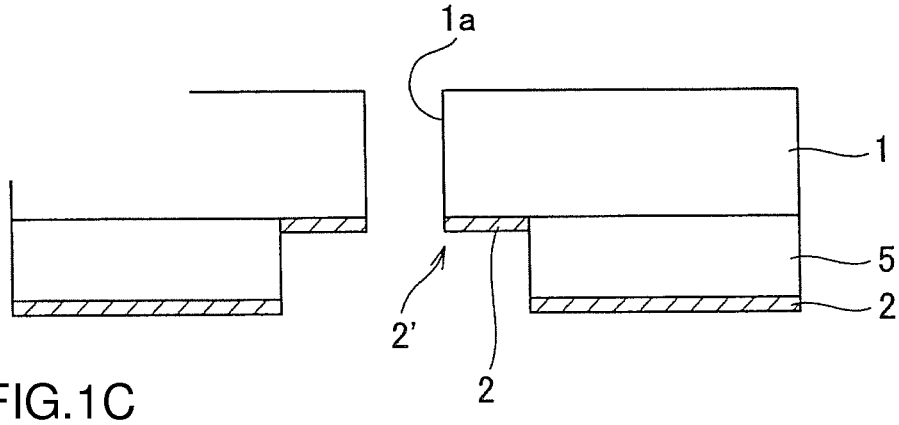

By a method of forming a cover plate 5 on the nozzle plate around the ink ejecting hole 1*a* (see JP-A-2005-7789) as shown in FIG. 1C, the ink-repellent layer 2 around the ink ejecting hole 1*a* can be hardly physically damaged due to the contact of the wiper. However, in the method described in JP-A-2005-7789, the end face (edge) 2' of the ink repellent layer 2 around the ink ejecting hole 1*a* is corroded, resulting in interference with the linear advancing property of ejected ink. If the chemical durability of the ink-repellent layer 2 is poor (for example, JP-A-2005-7789), the corrosion on the end face (edge) of the ink-repellent layer impairs the linear advancing property.

In embodiments of the present invention, since no ink-repellent layer 2 exists around the ink ejecting hole 1*a*, there is no factor of impairing the linear advancing property of ejected ink mentioned above, thereby providing good print quality.

A manufacturing method (processing method) of the nozzle plate for an inkjet head according to an embodiment of the present invention will be described with reference to FIGS. 2A and 2B, and FIGS. 3A and 3B.

Figure 2A:
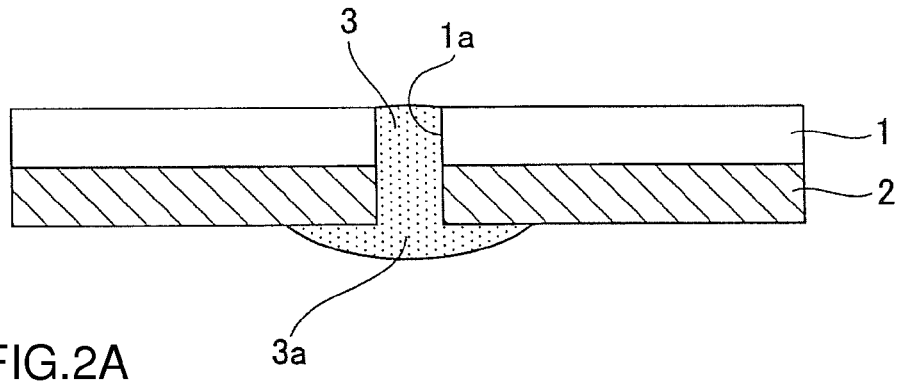
Figure 2B:
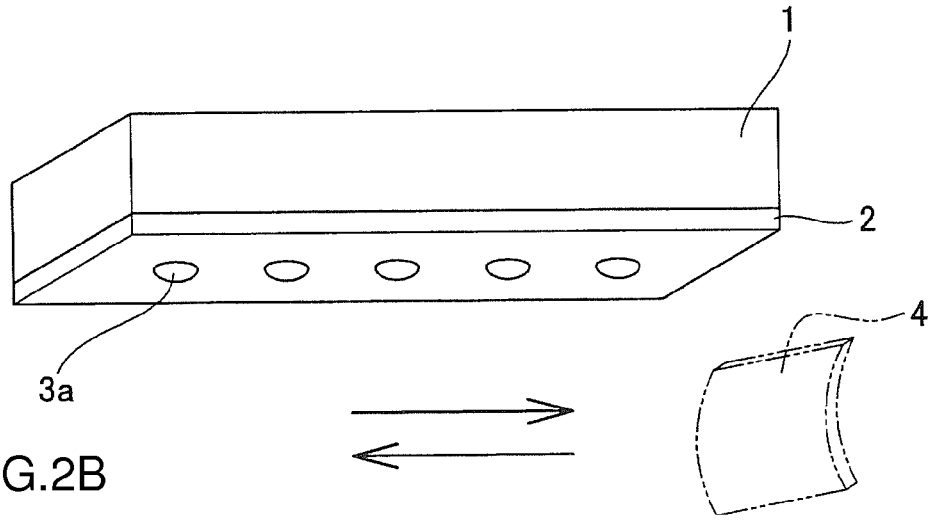

FIGS. 2A and 2B are schematic illustrations for explaining a situation that the ink ejecting hole of the nozzle plate in the inkjet head is filled with a treatment chemical for decreasing the mechanical strength of the ink-repellent layer. FIG. 2A is a sectional view and FIG. 2B is a perspective view.

Figure 3A:
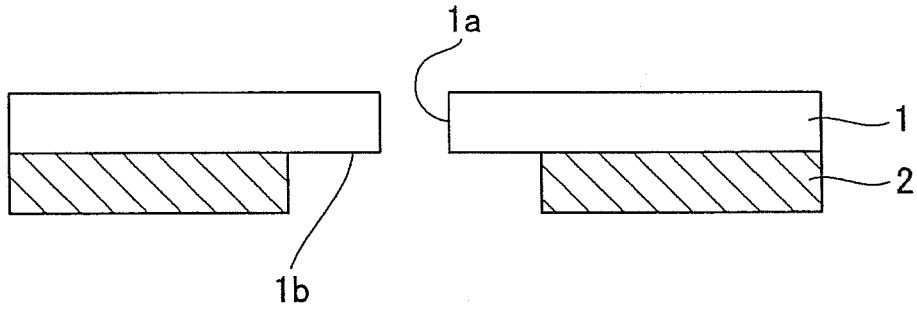
Figure 3B:
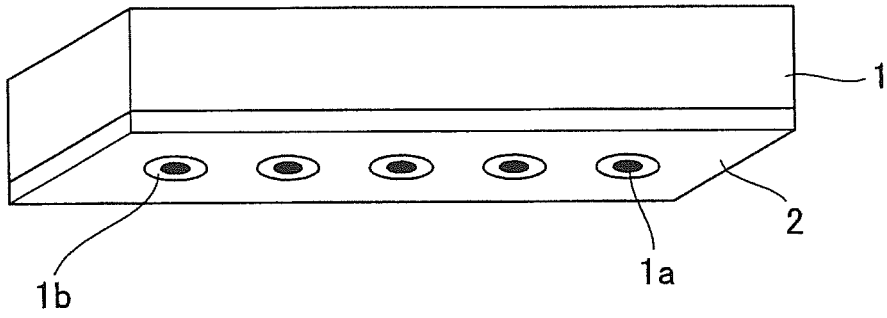

FIGS. 3A and 3B are illustrations for explaining a situation that the ink-repellent layer around the ink ejecting hole is selectively removed. FIG. 3A is a sectional view and FIG. 3B is a perspective view.

In the manufacturing method (processing method) according to the embodiment of the present invention, as shown in FIGS. 2A and 2B, a nozzle plate 1 comprising a flat plate-like substrate with ink ejecting holes 1*a* formed therein and having an ink-repellent layer 2 which is formed on an ink ejecting side thereof is prepared.

The nozzle plate 1 is made of an alloy material containing, for example, Ni or Fe.

The ink ejecting holes 1*a* are sometimes called nozzle openings or nozzle orifices.

The ink-repellent layer 2 is formed on an end face, i.e. the outermost surface, of the inkjet head.

In the manufacturing method (processing method) according to an embodiment of the present invention, portions around the ink ejecting holes of the ink-repellent layer are selectively removed. This process is preferably conducted by the following step (1) and step (2).

The step (1) is a step of selectively decreasing the mechanical strength of the ink-repellent layer 2 of portions around the ink ejecting holes 1*a* by filling a treatment chemical 3 into the ink ejecting holes 1*a* as shown in FIGS. 2A and 2B.

Specifically, as shown in FIGS. 2A and 2B, the nozzle plate 1 is horizontally held in a state that the ink ejecting side of the nozzle plate 1 faces downward and the treatment chemical 3 is poured into each ink ejecting hole 1*a* from above. Accordingly, as shown in FIGS. 2A and 2B, the treatment chemical 3 projecting from the surface of the ink ejecting side of the nozzle plate 1 produces a droplet (liquid pool) 3*a* because of the function of the ink-repellent layer 2. Therefore, the treatment chemical 3 can function selectively on a portion around the ink ejecting hole 1*a* of the ink-repellent layer, thereby selectively decreasing the mechanical strength of the ink-repellent layer at the portion around the ink ejecting hole 1*a*, i.e. an area in certain radius about the center of the ink ejecting hole 1*a*.

The step (2) is a step of selectively removing the portions about the ink ejecting holes of the ink-repellent layer of which the mechanical strength is selectively decreased.

Specifically, as shown in FIG. 2B, as an example of mechanical removing means, a blade 4 having flexibility is moved to slide on the ink-repellent layer 2 so as to rub the ink-repellent layer 2. Therefore, the portions around the ink ejecting holes of the ink-repellent layer 2 of which the mechanical strength is selectively decreased can be selectively removed.

As a result, as shown in FIGS. 3A and 3B, the portions around the ink ejecting holes 1*a* of the ink-repellent layer 2 are selectively (partially) removed so that the portions around the ink ejecting holes 1*a* of the nozzle plate (surface) 1*b* are exposed (become exposed surfaces).

Since the ink-repellent layer 2 of the nozzle plate thus obtained does not exist on the portions around the ink ejecting holes 1*a*, ink deflection, that may occur in case of a nozzle plate having an ink-repellent layer also existing on portions around ink ejecting holes, does not occur, thereby obtaining excellent print quality.

According to the manufacturing method (processing method) of an embodiment of the present invention, portions around the ink ejecting holes (nozzle openings, nozzle orifices) of the ink-repellent layer can be selectively removed in an easy manner as mentioned above.

Also according to the manufacturing method (processing method) of an embodiment of the present invention, the removal can be easily conducted at a site without a production facility exclusively for processing the nozzle plate, by placing a head to an inkjet printer before being treated and then supplying the treatment chemical to ink ejecting holes. Therefore, the process on demand at a customer's site is allowed.

The ink-repellent layer 2 is preferably a layer obtained by co-precipitating a fluororesin with a metal.

In the embodiment of the present invention, the layer obtained by co-precipitating a fluororesin with a metal is formed, for example, by a composite plating method. The composite plating method is a plating method in which fine particles are entered and mixed in a plating bath and are co-precipitated with the metal simultaneously so as to apply a new function to a thus formed layer. The composite plating can be electrolytic plating or electroless plating.

As the aforementioned fluororesin, resins such as PTFE (polytetrafluoroethylene), polyperfluoroalkoxy butadiene, polyfluorovinylidene, polyfluorovinyl, polydiperfluoroalkyl fumarate, PFA (tetrafluoroethylene-perfluoroalkylvinylether copolymer), FEP (tetrafluoroethylene-hexafluoropropylene copolymer), ETFE (tetrafluoroethylene-ethylene copolymer), PVDF (polyvinylidene fluoride), and PCTFE (polychlorotrifluoroethylene) may be used singly or in mixture. These fluororesins are capable of imparting ink repellency (water repellency). In addition, these fluororesins are stable relative to chemicals including acid, alkali, and/or organic solvent.

Preferably used as the aforementioned fluororesin are FEP (tetrafluoroethylene-hexafluoropropylene copolymer) and PTFE (polytetrafluoroethylene) because of their chemical durability and the like.

As the aforementioned metal, nickel, copper, silver, tin, zinc and the like can be used. Preferably used as the aforementioned metal are materials having great surface hardness and excellent abrasion resistance such as nickel, nickel-cobalt alloy, and nickel-boron alloy.

In the embodiment of the present invention, the treatment chemical 3 is preferably acidic liquid capable of gradually dissolving metal in the layer formed by co-precipitating the fluororesin with the metal.

Accordingly, only the fluororesin remains after dissolving the metal by the acidic liquid so as to decrease the mechanical strength of the eutectoid layer of the fluororesin and the metal. For example, when the ink-repellent layer is formed by eutectoid plating of Ni and FEP, the acidic liquid dissolves Ni so as to leave FEP only, thereby decreasing the mechanical strength of the ink-repellent layer.

The acidic liquid is preferably aqueous solution of which pH is in a range from 1.5 to 4.0 and, more preferably, aqueous solution containing organic carboxylic acid.

As the aforementioned organic carboxylic acid, hydroxycarboxylic acid (for example, glycolic acid), acetic acid, formic acid, and the like can be used. Preferably used as the aforementioned organic carboxylic acid is hydroxycarboxylic acid (for example, glycolic acid) because of its odor and biological safety.

Glycolic acid ($CH_2(OH)COOH$) is sometimes called hydroxyacetic acid, one of acids categorized as alpha-hydroxy acids (AHA) generally called fruit acids.

In the embodiment of the present invention, the wettability of the aforementioned acidic liquid is increased by adding penetrable surfactant into the acidic liquid. This is preferable because this imparts a function of promoting the dissolution of the portions around the nozzles of the ink-repellent layer 2.

In the embodiment of the present invention, the blade 4 is preferably a blade which satisfies characteristics such as having flexibility, having a function of mechanically promoting the removal of the ink-repellent layer 2, not skinning the surface of the ink-repellent layer 2, and being made of material capable of bearing with acid, alkali, and the like. For example, the blade 4 is preferably made of a rubber material. In the present invention, the material of the blade 4 is not limited to rubber material and may be any material satisfying the aforementioned characteristics.

In the embodiment of the present invention, the sliding action as one action of the blade is preferably conducted by reciprocation because the reciprocation provides an effect that the dissolved portions of the ink-repellent layer 2 can be removed without remaining at peripheries.

In addition, the sliding action is preferably conducted at certain intervals (periodically) because the periodical operation can reset variation in diameter and height among droplets 3*a* of the treatment chemical 3 (physically remove excess meniscus or the chemical around the nozzles) so as to adjust the diameters of removed portions, thereby homogenizing the diameters for respective nozzles.

In the embodiment of the present invention, as the mechanical removing means having the blade 4, a head cleaning mechanism comprising a wiping mechanism for an inkjet head in an inkjet printer can be employed. Therefore, the process on demand can be facilitated without a special device.

In the embodiment of the present invention, in case that glycolic acid is used as the treatment chemical 3, the concentration of glycolic acid in aqueous solution of glycolic acid is preferably in a range from 1 wt % to 10 wt %. The concentration lower than 1 wt % can not dissolve the metal to an extent as decreasing the mechanical strength of the ink-repellent layer 2 or takes too long time to dissolve the metal, while the concentration higher than 10 wt % makes the control for dissolution of the ink-repellent layer 2 difficult because of too high dissolving speed and may also dissolve the nozzle plate 1 below the ink-repellent layer if the dissolving effect is too strong.

If necessary, penetrable surfactant, for example acetylenic surfactant (example: Surfynol® 465 (available from Air Products and Chemicals, Inc.)) is added at a concentration of about 1 wt % to the treatment chemical 3. Since the addition of the penetrable surfactant increases the wettability, it is preferable because this imparts a function of promoting the dissolution of the portions around the nozzles of the ink-repellent layer 2. As the acetylenic surfactant, either a nonionic surfactant, a cationic surfactant, or an anionic surfactant may be used.

If the speed of dissolving the ink-repellent layer 2 by the treatment chemical 3 is too high, for example, diethylene glycol is added at a concentration of 0-15 wt % to the treatment chemical 3 so as to slow the reaction speed, thereby facilitating the control of the dissolving time of the ink-repellent layer 2.

The inkjet recording apparatus employed in an embodiment of the present invention may be an inkjet recording apparatus in which a piezoelectric element mechanically changes volume so as to form and eject ink droplets, i.e. so-called piezo head type inkjet recording apparatus, or an inkjet recording apparatus in which thermal energy is applied to ink composition to expand volume so as to form and eject ink droplets, i.e. so-called bubble jet type ("Bubble jet" is a registered trade name) or thermal jet type inkjet recording apparatus.

Embodiments of the nozzle plate of the present invention are extremely advantageously used in an inkjet recording method using piezoelectric element. Since the piezo type inkjet recording head has excellent durability, the piezo type inkjet recording head is especially preferably used in a field that requires a prolonged stable ejection such as textile printing. The nozzle plate extremely fits to the piezo type inkjet recording head so as to enable stable continuous ejection in a wide range of temperature. This is extremely suitable for textile printing on long media requiring huge quantities of ejection.

Though the material of the nozzle plate is not specially limited in the present invention, the nozzle plate is preferably made of metal, ceramics, silicon, glass, or plastic and, more preferably, made of a metal such as titanium, chromium, iron, cobalt, nickel, copper, zinc, tin, and gold; an alloy such as nickel-phosphorus alloy, tin-copper-phosphorus alloy, copper-zinc alloy, and stainless steel; polycarbonate; polysulfone; acrylonitrile-butadiene-styrene copolymer; polyethylene terephthalate; or one of various photosensitive resins.

The present invention is not limited to the embodiment mentioned above.

For example, liquid having a function of dissolving or decomposing at least parts of components of the ink-repellent layer or liquid having a function of dissolving or decomposing the ink-repellent layer may be employed as the treatment chemical 3. Then, by selectively effecting the function of the treatment chemical 3 at a portion around each ink ejecting hole 1*a* of the ink-repellent layer as shown in FIGS. 2A and 2B, the portion around each ink ejecting hole 1*a*, i.e. the area in certain radius about the center of each ink ejecting hole 1*a* of the ink-repellent layer can be selectively removed as shown in FIGS. 3A and 3B.

In addition, the treatment chemical 3 can be used as treatment liquid for an inkjet head without being entered in the ink ejecting holes, for example.

The nozzle plate with the ink-repellent layer of which portions around the ink ejecting holes are removed as shown in FIGS. 1A, 3A and 3B can be obtained by masking the non-removed portion of the ink-repellent layer and then treating the ink-repellent layer with the aforementioned treatment chemical 3 or more powerful inorganic acid. However, this procedure requires the masking, so it requires complex steps.

Similarly, the nozzle plate with the ink-repellent layer of which portions around the ink ejecting holes are removed as shown in FIGS. 1A, 3A and 3B can be obtained by masking the non-removed portion of the ink-repellent layer and then treating the ink-repellent layer with plasma irradiation described in JP-A-2003-63014. This procedure also requires the masking, so it is complex and further requires a plasma irradiation device.

Hereinafter, non-limiting, exemplary embodiments of the present invention will be described.

EXAMPLE 1

A nozzle plate for an inkjet head that was processed by the following procedure.

Preparation of Nozzle Plate:

An ink-repellent layer 2 was formed on the surface of the nozzle plate as shown in FIGS. 2A and 2B. The ink-repellent layer 2 was an electroless nickel/FEP (tetrafluoroethylene-hexafluoropropylene copolymer) composite plating layer formed by the electroless composite plating method.

Processing Procedure:

(1) Filling the Head with Acidic Treatment Chemical.

The inkjet head was filled with acidic treatment chemical in the same manner as normal filling of an inkjet head with ink. The composition and the pH of the acidic treatment chemical were as follows:

Composition of Acidic Treatment Chemical:

| | |
|---|---|
| Glycolic acid: | 10 wt % |
| Surfynol ®: | 1 wt % |
| Residual: | water |
| pH of acidic treatment chemical: | 1.5. |

(2) Periodic Wiping Operation.

Wiping operation was conducted 4-8 times periodically every two hours to selectively remove portions around ejecting outlets of the ink-repellent layer on the nozzle plate.

(3) Replacing with Cleaning Liquid.

After 2-12 hours from the wiping operation, the acidic treatment chemical was replaced with cleaning liquid.

(4) Cleaning Operation.

Residues around the nozzles were removed by the cleaning operation with the cleaning liquid.

It should be noted that the aforementioned steps (1) through (4) were conducted at a temperature of from 20 to 30° C.

Evaluation of the Process:

The head produced under the aforementioned conditions was observed with a microscope. As a result, it was found that the inkjet head had the nozzle plate in which portions around the ink ejecting holes of the ink-repellent layer were selectively removed as shown in FIGS. 3A and 3B.

Examination of Print Quality:

The inkjet head of Example 1 was mounted to a body of a large-scale inkjet printer and the head was filled with disperse dye ink. In this state, the inkjet printer ejected ink a 1 meter square area. By a nozzle check pattern, the number of deflections and the number of clogged nozzles were counted.

As a result of the examination under the aforementioned conditions, the number of clogged nozzles was zero and the number of deflections was zero, that is, no print defect was observed. This means that the inkjet head of this example enables the inkjet printer to obtain high print quality.

Though the head produced in the aforementioned example has the nozzle plate in which the portions around ink ejecting holes of the ink-repellent layer are selectively removed as shown in FIGS. 3A and 3B, the diameter of removed portions of the nozzle plate on the head can be arbitrarily selected by adjusting the dissolving time of the portions around the nozzles of the ink-repellent layer by acidic liquid. This procedure is not limited to the removal of portions around the ink ejecting holes as shown in FIGS. 3A and 3B.

EXAMPLE 2

An inkjet head of Example 2 was produced in the same manner as Example 1 except that the amount of glycolic acid was 1 wt % and the pH of the acidic treatment chemical was 3.9.

As a result of observing the produced head with a microscope, it was found that the inkjet head had the nozzle plate in which portions around the ink ejecting holes of the ink-repellent layer were selectively removed as shown in FIGS. 3A and 3B.

As a result of examination under the same conditions as Example 1, the number of clogged nozzles was zero and the number of deflections was zero, that is, no print defect was observed. This means that the inkjet head of this example enables the inkjet printer to obtain high print quality.

COMPARATIVE EXAMPLE 1

An inkjet head of Comparative Example 1 was produced in the same manner as Example 1 except that the amount of glycolic acid was 0.001 wt % and the pH of the acidic treatment chemical was 4.1.

As a result of observing the thus produced head with a microscope, it was found that the portions around the ink ejecting holes of the ink-repellent layer on the nozzle plate were not sufficiently dissolved so that the selectively removed portions were unclear and uneven in diameter.

As a result of examination under the same conditions as Example 1, the number of clogged nozzles was three and the number of deflections was fifteen, that is, print defects were observed. This means that the print quality was poor.

COMPARATIVE EXAMPLE 2

An inkjet head of Comparative Example 2 was produced in the same manner as Example 1 except that the amount of glycolic acid was 30 wt % and the pH of the acidic treatment chemical was 1.39.

As a result of observing the thus produced head with a microscope, it was found that the portions around the ink ejecting holes (orifices) of the ink-repellent layer on the nozzle plate were selectively removed such that the removed portions were uneven in diameter.

As a result of examination under the same conditions as Example 1, the number of clogged nozzles was five and the number of deflections was five, that is, the print quality was poor.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed is:

1. A method of producing a nozzle plate for an inkjet head, said method comprising:

preparing a nozzle plate which comprises a substrate and ink ejecting holes formed in the substrate and has an ink-repellent layer formed on an ink ejecting side surface of the nozzle plate; and selectively removing portions of the ink-repellant layer around the ink ejecting holes to expose portions of the nozzle plate around the ink ejecting holes, wherein the selectively removing of the portions of the ink-repellant layer around the ink ejecting holes comprises filling said ink ejecting holes with treatment chemical to selectively decrease the mechanical strength of the portions of the ink-repellant layer around the ink ejecting holes, and selectively removing the portions of the ink-repellant layer around the ink ejecting holes, where the mechanical strength is selectively decreased, by a mechanical removing device.

2. A method of producing a nozzle plate for an inkjet head as claimed in claim 1, wherein said ink-repellent layer is a layer obtained by co-precipitating a fluororesin with a metal, and wherein the mechanical strength of the portions of the ink-repellant layer around the ink ejecting holes is selectively decreased by filling said ink ejecting holes with acidic liquid.

3. A method of producing a nozzle plate for an inkjet head as claimed in claim 1, wherein selectively removing the portions of the ink-repellant layer around the ink ejecting holes by the mechanical removing device is conducted by moving a flexible blade to slide relative to said ink-repellent layer such that the ink-repellent layer is rubbed by the flexible blade.

4. A method of producing a nozzle plate for an inkjet head as claimed in claim 2, wherein selectively removing the portions of the ink-repellant layer around the ink ejecting holes by the mechanical removing device is conducted by moving a flexible blade to slide relative to said ink-repellent layer such that the ink-repellent layer is rubbed by the flexible blade.

5. A method of producing a nozzle plate for an inkjet head as claimed in claim 3, the sliding action of said flexible blade relative to the ink-repellent layer is performed at constant intervals.

6. A method of producing a nozzle plate for an inkjet head as claimed in claim 4, the sliding action of said flexible blade relative to the ink-repellent layer is performed at constant intervals.

7. A method of producing a nozzle plate for an inkjet head as claimed in claim 3, wherein said flexible blade is made of a rubber material.

8. A method of producing a nozzle plate for an inkjet head as claimed in claim 4, wherein said flexible blade is made of a rubber material.

9. A method of producing a nozzle plate for an inkjet head as claimed in claim 5, wherein said flexible blade is made of a rubber material.

10. A method of producing a nozzle plate for an inkjet head as claimed in claim 1, wherein said mechanical removing device is a head cleaning mechanism comprising a wiping mechanism for an inkjet head of an inkjet printer.

11. A method of producing a nozzle plate for an inkjet head as claimed in claim 2, wherein said mechanical removing device is a head cleaning mechanism comprising a wiping mechanism for an inkjet head of an inkjet printer.

12. A method of producing a nozzle plate for an inkjet head as claimed in claim 9, wherein said mechanical removing device is a head cleaning mechanism comprising a wiping mechanism for an inkjet head of an inkjet printer.

* * * * *